US009816411B2

(12) United States Patent
Hamada et al.

(10) Patent No.: US 9,816,411 B2
(45) Date of Patent: Nov. 14, 2017

(54) BREATHER DEVICE FOR ENGINE

(71) Applicant: KUBOTA Corporation, Osaka-shi, Osaka (JP)

(72) Inventors: Kazuya Hamada, Sakai (JP); Yuya Kimura, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 130 days.

(21) Appl. No.: 14/842,184

(22) Filed: Sep. 1, 2015

(65) Prior Publication Data

US 2016/0090882 A1 Mar. 31, 2016

(30) Foreign Application Priority Data

Sep. 25, 2014 (JP) ..... 2014-195625

(51) Int. Cl.

*F02B 25/06* (2006.01)
*F01M 13/04* (2006.01)
*F01M 13/00* (2006.01)

(52) U.S. Cl.

CPC . *F01M 13/0416* (2013.01); *F01M 2013/0072* (2013.01); *F01M 2013/0438* (2013.01)

(58) Field of Classification Search

CPC ..... F01M 13/0416
USPC ..... 123/572–574
See application file for complete search history.

(56) References Cited

U.S. PATENT DOCUMENTS 4,627,406 A * 12/1986 Namiki ..... F01M 13/04 123/572
5,551,409 A * 9/1996 Sanders ..... F01M 13/04 123/572
8,499,750 B2 * 8/2013 Koyamaishi ..... F01M 9/02 123/196 A
2004/0244785 A1 * 12/2004 Nishikawa ..... F01M 13/0416 123/574

(Continued)

FOREIGN PATENT DOCUMENTS

JP S61-183411 U 11/1986
JP 2003090204 A 3/2003
JP 2011-185182 A 9/2011

OTHER PUBLICATIONS

Office Action dated Sep. 13, 2017 in JP Application No. 2014-195625.

*Primary Examiner* — Marguerite McMahon
(74) *Attorney, Agent, or Firm* — Panitch Schwarze Belisario & Nadel LLP

(57) ABSTRACT

There is provided a breather device for an engine and capable of suppressing forming of separated oil into mist again. The breather device for the engine includes an oil filter chamber at a midpoint of a blow-by gas passing route and an oil filter housed in the oil filter chamber. The oil filter chamber is partitioned with a partition wall into an upstream filter chamber and a downstream filter chamber arranged in a front-back direction, the filter is formed by an upstream filter and a downstream filter, the upstream filter is housed in the upstream filter chamber and the downstream filter is housed in the downstream filter chamber, respectively, and a side gas expansion chamber is provided beside the oil filter chamber so that blow-by gas flows from the upstream filter into the downstream filter through the side gas expansion chamber.

10 Claims, 2 Drawing Sheets

(56) References Cited

U.S. PATENT DOCUMENTS

2014/0182569 A1* 7/2014 Hwang ..... F01M 13/04
123/572

* cited by examiner

FRONT
BACK

BREATHER DEVICE FOR ENGINE

BACKGROUND OF THE INVENTION (1) Field of the Invention

The present invention relates to a breather device for an engine.

(2) Description of Related Art

Conventionally, as a breather device for an engine, there is a device in which blow-by gas passing clearances are provided beside oil filters.

In the conventional breather device, if the separated oil separated from the blow-by gas by the oil filters accumulates in the blow-by gas passing clearances during operation of an engine, the separated oil is likely to be formed into mist again due to the blow-by gas passing through the narrow blow-by gas passing clearances at high speed.

SUMMARY OF THE INVENTION

An object of the present invention is to provide a breather device for an engine and capable of suppressing forming of separated oil into mist again.

Matters specifying the present invention are as follows.

In a breather device for an engine which includes an oil filter chamber at a midpoint of a blow-by gas passing route and an oil filter housed in the oil filter chamber, the oil filter chamber is partitioned with a partition wall into an upstream filter chamber and a downstream filter chamber arranged in a front-back direction, the filter is formed by an upstream filter and a downstream filter, the upstream filter is housed in the upstream filter chamber and the downstream filter is housed in the downstream filter chamber, respectively, and a side gas expansion chamber is provided beside the oil filter chamber so that blow-by gas flows from the upstream filter into the downstream filter through the side gas expansion chamber.

The invention exerts the following effects.

The separated oil is less likely to be formed into mist again in the side gas expansion chamber where the blow-by gas flows at a low flow rate even when the separated oil separated from the blow-by gas accumulates in the side gas expansion chamber.

It is possible to alternately carry out oil trapping with the upstream filter and the downstream filter and oil condensation in the side gas expansion chambers to strongly separate the oil from the blow-by gas.

BRIEF DESCRIPTION OF THE DRAWINGS

FIGS. 1A to 1D are diagrams for explaining a breather device for an engine according to the present invention, wherein FIG. 1A is a side view of a filter cartridge, FIG. 1B is a view taken in a direction of arrow B in FIG. 1A in which the filter cartridge is housed in a cartridge chamber, FIG. 1C is a view taken in a direction of arrow C in FIG. 1A, and FIG. 1D is a view taken in a direction of arrow D in FIG. 1A; and FIGS. 2A and 2B are diagrams for explaining a cylinder head cover including the breather device for the engine according to the invention, wherein FIG. 2A is a vertical sectional side view and FIG. 2B is a bottom view.

DETAILED DESCRIPTION OF PREFERRED EMBODIMENT

FIGS. 1A to 2B are diagrams for explaining a breather device for an engine according to an embodiment of the present invention. In the embodiment, the breather device for a vertical multicylinder spark-ignition engine will be described.

Figure 2A:
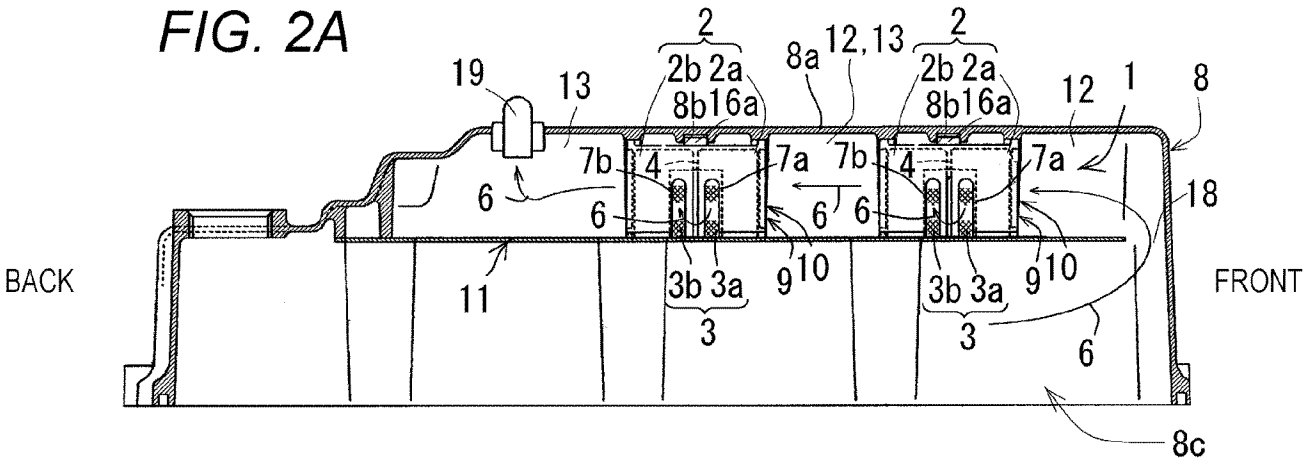
Figure 2B:
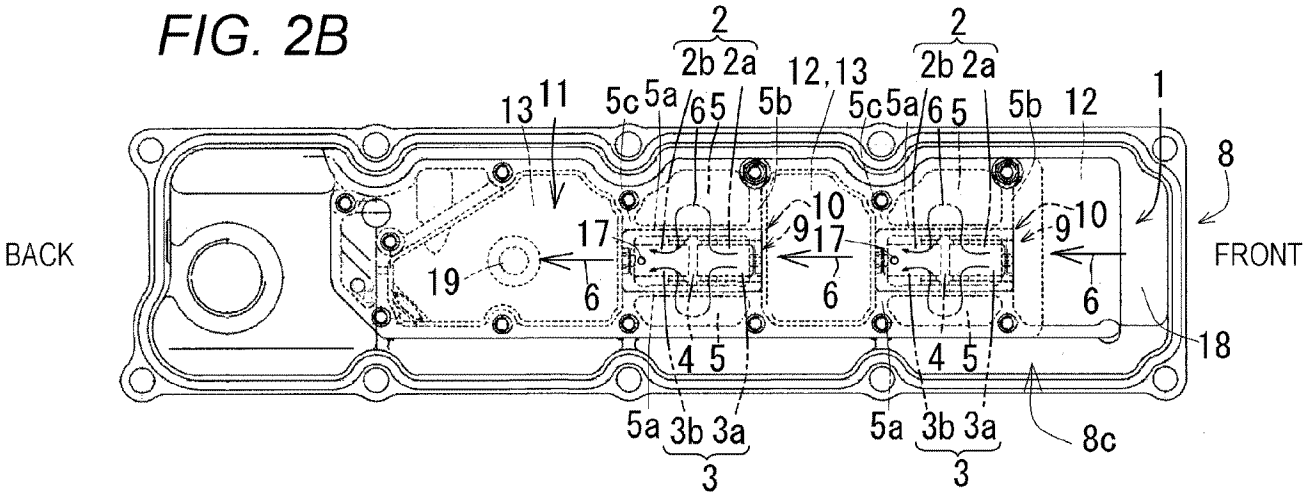

As shown in FIGS. 2A and 2B, the breather device for the engine includes oil filter chambers (2) at midpoints of a blow-by gas passing route (1) and an oil filter (3) housed in each of the oil filter chambers (2).

The blow-by gas passing route (1) is a route which is formed in a cylinder head cover (8) and through which blow-by gas (6) flows back from a crankcase (not shown) into an intake route (not shown). Steel wool is used for the oil filters (3). The steel wool is a three-dimensional reticulate composition formed by steel wire. For the oil filters (3), a three-dimensional reticulate composition such as glass wool, nonwoven fabric, and synthetic resin foam may be used besides the steel wool.

Figures 1A, 1B, 1C, 1D:
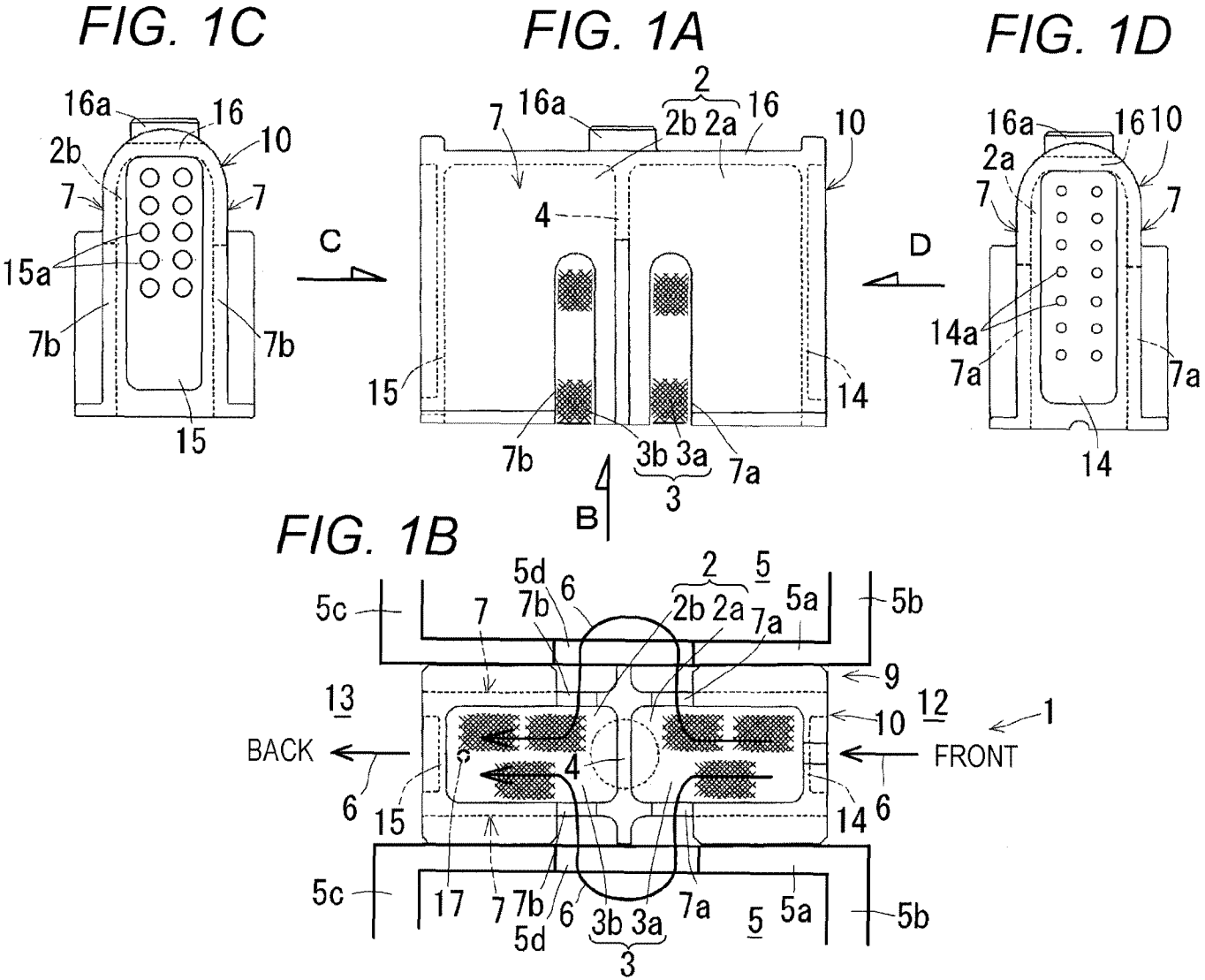

As shown in FIG. 1B, in the breather device, each of the oil filter chambers (2) is partitioned with a partition wall (4) into an upstream filter chamber (2*a*) and a downstream filter chamber (2*b*) arranged in a front-back direction, each of the filters (3) is formed by an upstream filter (3*a*) and a downstream filter (3*b*), the upstream filter (3*a*) is housed in the upstream filter chamber (2*a*) and the downstream filter (3*b*) is housed in the downstream filter chamber (2*b*), respectively, and side gas expansion chambers (5) are provided beside the oil filter chamber (2) so that the blow-by gas (6) flows from the upstream filter (3*a*) into the downstream filter (3*b*) through the side gas expansion chambers (5). Therefore, the separated oil is less likely to be formed into mist again in the side gas expansion chamber (5) where the blow-by gas (6) flows at a low flow rate even when the separated oil separated from the blow-by gas (6) accumulates in the side gas expansion chamber (5). Further, it is possible to alternately carry out oil trapping with the upstream filter (3*a*) and the downstream filter (3*b*) and oil condensation in the side gas expansion chambers (5) to strongly separate the oil from the blow-by gas (6).

As shown in FIGS. 2A and 2B, in the breather device, a longitudinal direction of the cylinder head cover (8) is defined as the front-back direction, a breather inlet (18) is provided to a front end portion of the blow-by gas passing route (1) and a breather outlet (19) is provided in a position close to a back side of the blow-by gas passing route (1). The breather inlet (18) is open to face a rocker arm chamber (8*c*) in the cylinder head cover (8) and the breather outlet (19) is connected to the intake route (not shown). A PCV valve may be provided to the breather outlet (19). The rocker arm chamber (8*c*) is provided below the blow-by gas passing route (1).

As shown in FIGS. 1B and 2B, in the breather device, the side gas expansion chambers (5) are disposed on the opposite sides of the oil filter chambers (2). Therefore, the device has the high function of strongly separating the oil from the blow-by gas (6).

As shown in FIG. 1B, in the breather device, side walls (7) are provided between each of the oil filter chambers (2) and the side gas expansion chambers (5) and upstream filter chamber outlets (7*a*) and downstream filter chamber inlets (7*b*) are open respectively in portions of the side walls (7) close to the partition wall (4). Therefore, the blow-by gas (6) flows out from the upstream filter chamber outlets (7*a*) into the side gas expansion chambers (5), the blow-by gas (6) flows from the side gas expansion chambers (5) into the downstream filter chamber inlets (7*b*), the flows of blow-by gas (6) in opposite directions closely pass each other in the side gas expansion chambers (5), oil mist included in the blow-by gas (6) collides, particle diameters of oil droplets increase, and the oil separating function in the side gas expansion chambers (5) is improved.

The side walls (7) are side walls (7) of a filter cartridge (10) (described later).

As shown in FIGS. 2A and 2B, in the breather device, the blow-by gas passing route (1) is provided along a ceiling wall (8*a*) of the cylinder head cover (8) and the side gas expansion chambers (5) and cartridge chambers (9) are provided below the ceiling wall (8*a*) of the cylinder head cover (8).

As shown in FIG. 1B, the filter cartridge (10) is housed in each of the cartridge chambers (9) and the upstream filter chamber (2*a*) and the downstream filter chamber (2*b*) are provided in the filter cartridge (10). Therefore, by merely housing the filter cartridge (10) in the cartridge chamber (9), it is possible to dispose the upstream filter (3*a*) and the downstream filter (3*b*) at proper positions in the blow-by gas passing route (1), which facilitates the mounting operation of the upstream filter (3*a*) and the downstream filter (3*b*).

As shown in FIGS. 1B and 2B, an upstream gas expansion chamber (12) is disposed on a front side and a downstream gas expansion chamber (13) is disposed on a back side of the side gas expansion chambers (5) and the cartridge chambers (9), respectively. Ceiling walls of the side gas expansion chambers (5), the cartridge chambers (9), the upstream gas expansion chamber (12), and the downstream gas expansion chamber (13) are formed by the ceiling wall (8*a*) of the cylinder head cover (8) and the side gas expansion chambers (5) and each of the cartridge chambers (9) are partitioned by side walls (5*a*) of the side gas expansion chambers (5). The side gas expansion chamber (5) and the upstream gas expansion chamber (12) are partitioned by an upstream wall (5*b*) of the side gas expansion chamber (5) and the side gas expansion chamber (5) and the downstream gas expansion chamber (13) are partitioned by a downstream wall (5*c*) of the side gas expansion chamber (5).

The side walls (5*a*), the upstream wall (5*b*), and the downstream wall (5*c*) of each of the side gas expansion chambers (5) are lead out downward from the ceiling wall (8*a*) of the cylinder head cover (8).

In the side walls (5*a*) of the side gas expansion chambers (5), connecting holes (5*d*) facing the upstream filter chamber outlets (7*a*) and the downstream filter chamber inlets (7*b*) provided in the side walls (7) of the filter cartridge (10) are open.

As shown in FIGS. 1A to 1D, the filter cartridge (10) includes the opposite side walls (7), (7), an upstream wall (14), a downstream wall (15), a ceiling wall (16), and the partition wall (4) and is open downward and covered with a single bottom plate (11) (described later) from below.

The upstream wall (14) of the filter cartridge (10) partitions the upstream filter chamber (2*a*) and the upstream gas expansion chamber (12) from each other and the downstream wall (15) of the filter cartridge (10) partitions the downstream filter chamber (2*b*) and the downstream gas expansion chamber (13) from each other. A plurality of blow-by gas inlet holes (14*a*) are open in the upstream wall (14) and a plurality of blow-by gas outlet holes (15*a*) are open in the downstream wall (15) of the filter cartridge (10), respectively. A locking pin (16*a*) is provided to the ceiling wall (16) of the filter cartridge (10).

As shown in FIGS. 2A, 2B, and FIG. 1B, in the breather device, the filter cartridge (10) is detachably housed in the cartridge chamber (9). Therefore, it is possible to maintain or replace the oil filter (3) without getting his/her hands dirty due to direct touch with the oil filter (3).

As shown in FIG. 1B, the filter cartridge (10) is inserted into the cartridge chamber (9) from below.

As shown in FIGS. 2A and 2B, in the breather device, the side gas expansion chambers (5) and the filter cartridge (10) are covered with the single bottom plate (11) from below, the bottom plate (11) forms bottom walls of the side gas expansion chambers (5) and supports the filter cartridge (10) in each of the cartridge chambers (9). Therefore, the single bottom plate (11) is used both as the bottom walls of the side gas expansion chambers (5) and a support plate for the filter cartridge (10), which reduces the number of parts.

The filter cartridge (10) is placed on an upper face of the single bottom plate (11) and pressed against the ceiling wall (8*a*) of the cylinder head cover (8). The locking pin (16*a*) of the ceiling wall (16) of the filter cartridge (10) is locked into a locking hole (8*b*) in the ceiling wall (8*a*) of the cylinder head cover (8) so as to prevent displacement of the filter cartridge (10) in the front-back direction.

As shown in FIGS. 2A and 2B, in the breather device, the two oil filter chambers (2), (2) are disposed in series in the blow-by gas passing route (1). In other words, in the breather device, the two filter cartridges (10), (10) are disposed in series in the blow-by gas passing route (1). Therefore, it is possible to improve an oil separating function of the blow-by gas passing route (1).

As shown in FIGS. 1A and 1B, in the breather device, the upstream gas expansion chamber (12) is disposed in front of the front filter cartridge (10), the downstream gas expansion chamber (13) is disposed behind the back filter cartridge (10), and a dual-purpose expansion chamber functioning both as a downstream gas expansion chamber (13) for the front filter cartridge (10) and an upstream gas expansion chamber (12) for the back filter cartridge (10) is disposed between the front filter cartridge (10) and the back filter cartridge (10).

The upstream gas expansion chamber (12) and the downstream gas expansion chamber (13) are open downward and covered with the single bottom plate (11) from below and the bottom plate (11) forms bottom walls of the upstream gas expansion chamber (12) and the downstream gas expansion chamber (13).

The number of oil filter chambers (2), (2) disposed in series in the blow-by gas passing route (1) may be three or more. In other words, in the breather device, the three or more filter cartridges (10), (10) may be disposed in series in the blow-by gas passing route (1).

As shown in FIGS. 1B and 2B, oil dropping holes (17) are open in the bottom plate (11) and the oil dropping holes (17) are disposed in positions close to the downstream walls (15) of the respective downstream filter chambers (2*b*).

Part of the oil trapped by the upstream filter (3*a*) and the downstream filter (3*b*) and the oil condensed in the side gas expansion chambers (5) accumulates on the bottoms of the side gas expansion chambers (5) during operation of the engine and permeates the downstream filters (3*b*) and drops into the rocker arm chamber (8*c*) through the oil dropping holes (17) during stoppage of the engine.

The oil condensed in the upstream gas expansion chamber (12) in front of the front filter cartridge (10) during the operation of the engine drops into the rocker arm chamber (8*c*) through the breather inlet (18) during the operation or the stoppage of the engine.

The oil condensed in the dual-purpose expansion chamber functioning both as the downstream gas expansion chamber (13) behind the front filter cartridge (10) and the upstream gas expansion chamber (12) in front of the back filter cartridge (10) accumulates on a bottom of the dual-purpose expansion chamber during the operation of the engine and permeates the downstream filter (3*b*) of the front filter cartridge (10) and drops into the rocker arm chamber (8*c*) through the oil dropping holes (17) in a bottom of the downstream filter (3*b*) during the stoppage of the engine.

The oil condensed in the downstream gas expansion chamber (13) behind the back filter cartridge (10) accumulates on the bottom of the downstream gas expansion chamber (13) during the operation of the engine and permeates the downstream filter (3*b*) of the back filter cartridge (10) and drops into the rocker arm chamber (8*c*) through the oil dropping holes (17) in a bottom of the downstream filter (3*b*) during the stoppage of the engine.

What is claimed is:

1. A breather device for an engine and comprising an oil filter chamber at a midpoint of a blow-by gas passing route and an oil filter housed in the oil filter chamber, wherein the oil filter chamber is partitioned with a partition wall into an upstream filter chamber and a downstream filter chamber arranged in a front-back direction, the filter is formed by an upstream filter and a downstream filter, the upstream filter is housed in the upstream filter chamber and the downstream filter is housed in the downstream filter chamber, respectively, and a side gas expansion chamber is provided beside the oil filter chamber so that blow-by gas flows from the upstream filter into the downstream filter through the side gas expansion chamber, and wherein a side wall is provided between the oil filter chamber and the side gas expansion chamber and an upstream filter chamber outlet and a downstream filter chamber inlet are open respectively in portions of the side wall close to the partition wall.

2. The breather device for the engine according to claim 1, wherein the side gas expansion chamber is provided on each of opposite sides of the oil filter chamber.

3. The breather device for the engine according to claim 1, wherein the blow-by gas passing route is provided along a ceiling wall of a cylinder head cover, the side gas expansion chamber and a cartridge chamber are provided below the ceiling wall of the cylinder head cover, a filter cartridge is housed in the cartridge chamber, and the upstream filter chamber and the downstream filter chamber are provided in the filter cartridge.

4. The breather device for the engine according to claim 2, wherein the blow-by gas passing route is provided along a ceiling wall of a cylinder head cover, the side gas expansion chamber and a cartridge chamber are provided below the ceiling wall of the cylinder head cover, a filter cartridge is housed in the cartridge chamber, and the upstream filter chamber and the downstream filter chamber are provided in the filter cartridge.

5. The breather device for the engine according to claim 3, wherein the filter cartridge is detachably housed in the cartridge chamber.

6. The breather device for the engine according to claim 4, wherein the filter cartridge is detachably housed in the cartridge chamber.

7. The breather device for the engine according to claim 5, wherein the side gas expansion chamber and the filter cartridge are covered with a single bottom plate from below and the bottom plate forms a bottom wall of the side gas expansion chamber and supports the filter cartridge in the cartridge chamber.

8. The breather device for the engine according to claim 6, wherein the side gas expansion chamber and the filter cartridge are covered with a single bottom plate from below and the bottom plate forms a bottom wall of the side gas expansion chamber and supports the filter cartridge in the cartridge chamber.

9. The breather device for the engine according to claim 1, wherein the plurality of oil filter chambers are disposed in series in the blow-by gas passing route.

10. The breather device for the engine according to claim 2, wherein the plurality of oil filter chambers are disposed in series in the blow-by gas passing route.

* * * * *